United States Patent [19]

Akino

[11] Patent Number: 4,757,546

[45] Date of Patent: Jul. 12, 1988

[54] NARROW DIRECTIONAL MICROPHONE

[75] Inventor: Hiroshi Akino, Sagamihara, Japan

[73] Assignee: Kabushiki Kaisha Audio-Technica, Tokyo, Japan

[21] Appl. No.: 931,708

[22] Filed: Nov. 17, 1986

[30] Foreign Application Priority Data

Nov. 19, 1985 [JP] Japan ..... 60-259186

[51] Int. Cl.[4] ..... H04R 1/32; H04R 1/34; H04R 7/00

[52] U.S. Cl. ..... 381/155; 381/167; 381/202

[58] Field of Search ..... 381/155, 168, 169, 154, 381/202

[56] References Cited

U.S. PATENT DOCUMENTS

| | | | |
|---|---|---|---|
| 2,210,415 | 8/1940 | Kellogg | 381/186 |
| 3,082,298 | 3/1963 | Görike | 381/186 |
| 3,095,484 | 6/1963 | Beaverson et al. | 381/155 |
| 3,444,955 | 5/1969 | Hoffmann | 381/154 |
| 4,264,790 | 4/1981 | Zlevor | 381/155 |
| 4,340,787 | 7/1982 | Görike | 381/155 |
| 4,363,937 | 12/1982 | Bruna | 381/155 |

FOREIGN PATENT DOCUMENTS

| | | | |
|---|---|---|---|
| 1522906 | 4/1968 | France | 381/169 |
| 23957 | 5/1977 | Japan | 381/155 |

*Primary Examiner*—Jin F. Ng
*Assistant Examiner*—Danita R. Byrd
*Attorney, Agent, or Firm*—Welsh & Katz, Ltd.

[57] ABSTRACT

A narrow directional microphone comprising a microphone unit and an interference tube with one end covering a forward audio terminal of the microphone. The interference tube has a plurality of first openings spaced from one another axially on the tube for providing acoustic resistance. The interference tube has a plurality of second openings spaced circumferentially from the first openings about the interference tube with a diaphragm secured to the interference tube for covering the second openings.

10 Claims, 1 Drawing Sheet

NARROW DIRECTIONAL MICROPHONE

FIELD OF INVENTION

This invention relates to a narrow directional microphone, and more particularly a narrow directional microphone of a type wherein an interference pipe or tube is attached such that its one end covers a forward sound audio terminal of the microphone unit.

In the prior art, attempts have been made to narrow the directional orientation of a microphone by attaching an interference tube at a tip end of the microphone unit. In this interference tube, the length is determined by the lowest frequency contemplated as being used. When the frequency becomes higher, acoustic resistive material can be provided in a moveable manner about the interference tube to, in effect, shorten the length of the interference tube acoustically. However, it can be rather inconvenient to require the measurement of the audio frequency experienced at a particular time and then adjust the position of the acoustic resistive material in response to that frequency.

BACKGROUND OF THE INVENTION

In U.S. Pat. No. 3,444,955, there is disclosed an interference tube for a narrow directional microphone wherein a plurality of openings are provided along an axial direction. The diameter of each successive opening on the sound collecting side is diminished the further away the opening is from the microphone unit. Thus, the acoustic resistance of the microphone gradually increases along the length of the tube. A cover member of an acoustic resistive material covers each opening, and its position over the opening can be changed so that a narrow directional flat frequency and good sound quality is achieved. However, as the orientation can be adjusted only by the openings and the covering acoustic resistive materials, the lowest interference frequency is limited by the length of the tube. To obtain a narrow directional orientation, the tube length should be elongated, which can be inconvenient.

SUMMARY OF THE INVENTION

An object of the subject invention is a narrow directional microphone which extends to the lowest limit of the interference frequency without substantially elongating the length of the interference tube.

According to this invention, another set of openings for acoustic resistance are used as an impedance of the interference tube. Further, a diaphragm covers these openings, thereby providing a microphone which has a relatively high narrow directional orientation.

More specifically, this invention relates to a narrow directional microphone having a microphone unit, and an interference tube which, at its one end covers a front audio terminal of the microphone. The microphone has a first plurality of spaced openings for acoustic resistance formed on the interference tube in an axial direction and a plurality of second openings spaced from said first openings in a circumferential direction and extending away from the one end in an axial direction. A diaphragm covers the second openings and is attached to the interference tube.

BRIEF DESCRIPTION OF THE ACCOMPANYING DRAWINGS

DESCRIPTION OF THE PREFERRED EMBODIMENT

Figure 1:
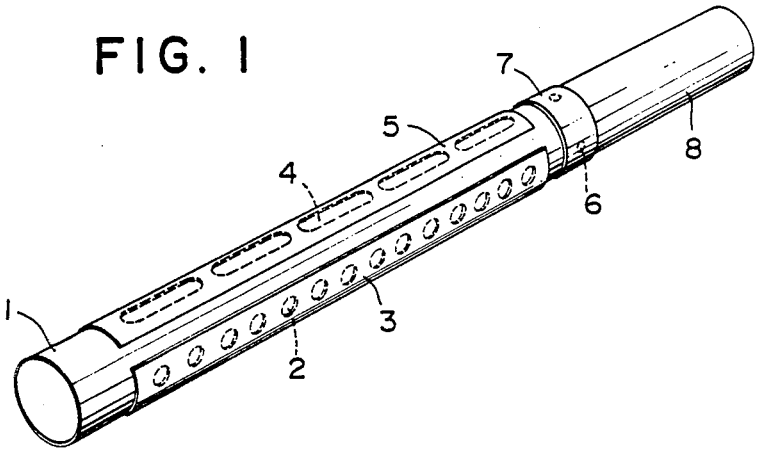
FIG. 1 is a perspective view of one embodiment of the narrow directional microphone of the subject invention.
Figure 2:
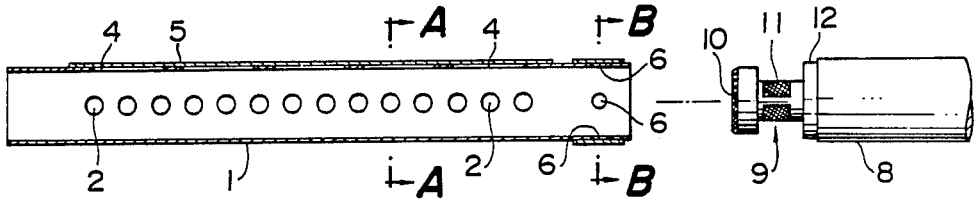
FIG. 2 is a plan view showing separated the interference tube and a microphone unit of FIG. 1.
Figure 3:
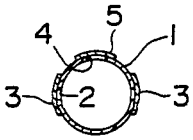
FIG. 3 is a horizontal cross section showing a view along a line A—A of FIG. 2.
Figure 4:
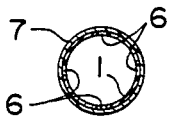
FIG. 4 is a horizontal cross section showing a view along a line B—B of FIG. 2.
Figure 5:
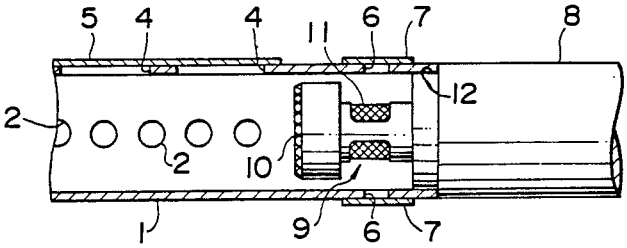
FIG. 5 is a longitudinal cross section showing a connection state of the interference tube and the microphone unit of FIG. 1.

As shown in FIG. 1, an interference pipe or tube 1, formed of a metal such as aluminum, has both ends in its axial direction open; a plurality of openings 2 for providing acoustic resistance extend axially from its forward tip end to its back end. An acoustic resistive material 3 such as a non-woven textile adheres to an exterior surface of the interference tube 1 and covers an upper face of the openings 2. As apparent from FIG. 3, another set of identical openings are formed as mirror images of the first openings on the interference tube. This other set of openings is disposed 180° opposite the first set of openings and an acoustic resistive materials 3 also adheres to the tube walls to cover these openings.

A series of elongated holes 4 are provided on the tube walls from openings 2 at a distance of 90°. A diaphragm 5 of a thin synthetic resin film, such as polyvinylidene fluoride is secured to an exterior face of the interference tube 1 so as to cover the outer face of the elongated holes 4. These elongated holes 4 and diaphragm 5 combine to prevent resonance in the interference tube and control phase change and the introduction of sound. The size and tension of the diaphragm are set by the amplitude of the desired phase change and the sound introduced from the side of the interference tube 1.

A plurality of sound inlets 6 are formed about the circumference of the interference tube back end. An interference material 7 of a non-woven textile such as felt and nylon mesh is attached to the tube to cover the sound inlets 6. A grip 8 having a switch for operation of the microphone (not shown) is mounted at the extreme back end of the interference tube 1 by attachment of the back end to a forward tip end 12 of the grip 8.

The outer periphery of the microphone unit 9 is smaller than the inner diameter of the interference tube 1. Microphone unit 9 has a front audio terminal 10 and a rear audio terminal 11. The tip end 12 is an area of reduced circumference or shoulder to which the rear end of the interference tube 1 is attached. The shoulder 12 maintains a space between the outer periphery of the microphone unit 9 and the inner periphery of the rear portion of the interference tube 1. A sound opening is located on the interference tube over an outer face of the rear sound terminal 11 of the microphone unit 9.

When the tip or outer end of the interference tube 1 is tilted at a certain angle from a sound source, the sound from the sound source is introduced directly into the interference tube 1, while phase changed sound is introduced from the side face of the interference tube 1 through the acoustic resistive material 3 and the openings, thereby interfering with the directly introduced sound. Furthermore, sound is introduced through the diaphragm 5 and the openings 4 from a side of the interference tube 1, but this sound is generated by the oscillation of the diaphragm 5 having a larger mass than the acoustic resistive material 3, and its phase changes are larger and at a lower frequency than the sound coming through the acoustic resistive material 3. This phase changed sound interferes with the sound directly introduced, thereby attenuating the sound which approaches the microphone on a line substantially on an axial line of the interference tube 1.

In this invention, an additional pair of openings are present. These additional openings are covered by a diaphragm so that the sound directly introduced into the interference tube encounters interference or phase shifting, and hence, the sound is amplified and phase shifted as it is transmitted from the open end of the tube to the microphone unit, thereby providing a microphone of very narrow directional orientation, yet the tube seems to function as though it were longer than it is. In the conventional narrow directional microphone, the interference is set only by a mass of air in the interference tube, its compliance and the acoustic resistance of the acoustic resistive material, while in this invention, sound interference is obtained at substantially lower frequency from permeation and oscillation re-radiation by mass of the diaphragm and compliance and sound pressure permeating inside through the acoustic resistance by the second openings, and the sound propagating in the tube by the oscillation re-radiation.

While the invention has been described with reference to a preferred embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments and equivalents falling within the scope of the appended claims.

Various features of the invention are set forth in the following claims.

What is claimed is:

1. A directional microphone comprising a microphone unit, a grip means and an interference tube, said interference tube having an open end and a grip end, said grip end secured to said grip means, said microphone unit being positioned within said interference tube and spaced therefrom, a plurality of first openings axially spaced along said interference tube, said interference tube having a plurality of second openings axially spaced on said interference tube located approximately 90° from said first openings on said interference tube, and a diaphragm secured to said interference tube so as to cover said second openings, thereby amplifying the sound while shifting its phase so that the length of said interference tube functionally appears longer.

2. The directional microphone of claim 1 wherein said diaphragm comprises a thin layer of synthetic resin.

3. The directional microphone of claim 1 wherein said diaphragm is formed of polyvinylidene fluoride.

4. The directional microphone of claim 1 wherein an acoustic resistive material is secured to said interference tube so as to cover said first openings, said material comprising a non-woven textile.

5. The directional microphone of claim 1 further including third openings 180°opposite said first openings, said third openings comprising a mirror image of said first openings.

6. The directional microphone of claim 5, wherein acoustic resistive material covers both said first and third openings.

7. The directional microphone of claim 1 wherein said second openings are elongated along the axial direction of said interference tube.

8. A directional microphone comprising a microphone unit, a grip means and an interference tube, said interference tube having an open end and a grip end, said grip end secured to said grip means, said microphone unit being positioned within said interference tube and spaced therefrom, a plurality of first openings axially spaced along said interference tube, said first openings covered by a non-woven textile for acoustic resistance, said interference tube having a plurality of second openings axially spaced on said interference tube located approximately 90° away from said first openings on said interference tube and a diaphragm comprising a thin layer of polyvinylidene fluoride secured to said interference tube so as to cover said second openings, thereby amplifying the sound while shifting its phase so that the length of said interference tube functionally appears longer.

9. The directional microphone of claim 8 further including third openings approximately 180° opposite said first openings.

10. The directional microphone of claim 9, wherein said third openings are covered by a non-woven textile.

* * * * *